US009856840B2

(12) United States Patent
Puckett et al.

(10) Patent No.: US 9,856,840 B2
(45) Date of Patent: Jan. 2, 2018

(54) END-OF-CURRENT TRIM FOR COMMON RAIL FUEL SYSTEM

(71) Applicant: Caterpillar Inc., Peoria, IL (US)

(72) Inventors: Daniel R. Puckett, Peoria, IL (US); Bryan Moore, Washington, IL (US); Michael E. Sattler, Eureka, IL (US); Prasanna M. Ballal, Peoria, IL (US); Bradley S. Bashore, Peoria, IL (US); Kranti K. Nellutla, Bloomington, IL (US)

(73) Assignee: Caterpiller Inc., Peoria, IL (US)

( * ) Notice: Subject to any disclaimer, the term of this patent is extended or adjusted under 35 U.S.C. 154(b) by 8 days.

(21) Appl. No.: 15/195,075

(22) Filed: Jun. 28, 2016

(65) Prior Publication Data

US 2016/0305383 A1 Oct. 20, 2016

Related U.S. Application Data

(62) Division of application No. 14/153,485, filed on Jan. 13, 2014, now Pat. No. 9,394,848.

(51) Int. Cl.

| | |
|---|---|
| ***F02B 15/00*** | (2006.01) |
| ***F02M 47/02*** | (2006.01) |
| ***F02D 41/38*** | (2006.01) |
| ***F02M 51/06*** | (2006.01) |
| ***F02D 41/20*** | (2006.01) |
| ***F02M 63/00*** | (2006.01) |
| ***F02D 41/30*** | (2006.01) |

(52) U.S. Cl.

CPC ..... *F02M 47/027* (2013.01); *F02D 41/20* (2013.01); *F02D 41/3082* (2013.01); *F02D 41/3836* (2013.01); *F02M 51/0625* (2013.01); *F02M 63/0022* (2013.01); *F02M 63/0075* (2013.01); *F02D 2041/2044* (2013.01); *F02D 2041/2051* (2013.01); *F02D 2041/2055* (2013.01); *F02D 2041/2058* (2013.01)

(58) Field of Classification Search

CPC ..... F02D 19/081; F02D 41/2441; F02D 41/2055; F02D 41/2058

USPC ..... 123/434, 673, 490, 491, 456; 701/103–105, 115

See application file for complete search history.

(56) References Cited

U.S. PATENT DOCUMENTS

| | | | |
|---|---|---|---|
| 4,213,181 | A | 7/1980 | Carp et al. |
| 5,986,871 | A | 11/1999 | Forck et al. |
| 6,737,946 | B2 | 5/2004 | Seale et al. |
| 6,739,293 | B2 | 5/2004 | Turner et al. |

(Continued)

FOREIGN PATENT DOCUMENTS

| | | |
|---|---|---|
| EP | 2529090 | 3/2013 |

*Primary Examiner* — John Kwon

(74) *Attorney, Agent, or Firm* — Liell & McNeil; John P. Wappel

(57) ABSTRACT

Fuel is injected by energizing a solenoid of a fuel injector for an on-time that terminates at a first end-of-current timing. An end-of-current trim is determined at least in part by estimating a duration between an induced current event in a circuit of the solenoid and a valve/armature interaction event. An induced current event occurs when an armature abruptly stops, and a valve/armature interaction event occurs when the armature couples with or de-couples from the valve member. Fuel is injected in a subsequent injection event by adjusting the end-of-current timing by the end-of-current trim.

10 Claims, 4 Drawing Sheets

(56) References Cited

U.S. PATENT DOCUMENTS

| | | | | |
|---|---|---|---|---|
| 6,748,928 | B2 | 6/2004 | Shingole | |
| 7,469,679 | B2 | 12/2008 | Puckett et al. | |
| 8,122,963 | B2 | 2/2012 | Davis | |
| 8,448,878 | B2 | 5/2013 | Ibrahim et al. | |
| 8,485,148 | B2 | 7/2013 | Schiemann | |
| 2004/0055562 | A1* | 3/2004 | Stewart | F02M 45/02 123/299 |
| 2004/0108394 | A1* | 6/2004 | Lawrence | F02M 45/086 239/533.2 |
| 2004/0181760 | A1* | 9/2004 | Ismailov | F02D 41/20 703/2 |
| 2007/0272213 | A1 | 11/2007 | Gibson | |
| 2008/0059039 | A1* | 3/2008 | Nakagawa | F02D 41/2464 701/99 |
| 2010/0282212 | A1* | 11/2010 | Shafer | F02M 63/025 123/456 |
| 2011/0137544 | A1 | 6/2011 | Kawazu et al. | |
| 2012/0029797 | A1 | 2/2012 | Notani | |
| 2012/0067329 | A1* | 3/2012 | Bunni | F02D 41/20 123/490 |
| 2014/0216373 | A1 | 8/2014 | Church | |

* cited by examiner

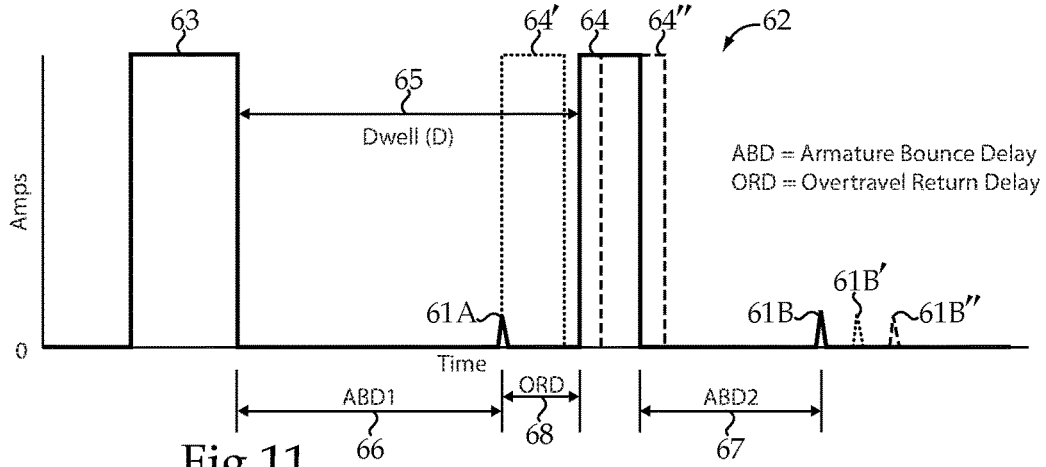
Fig.11
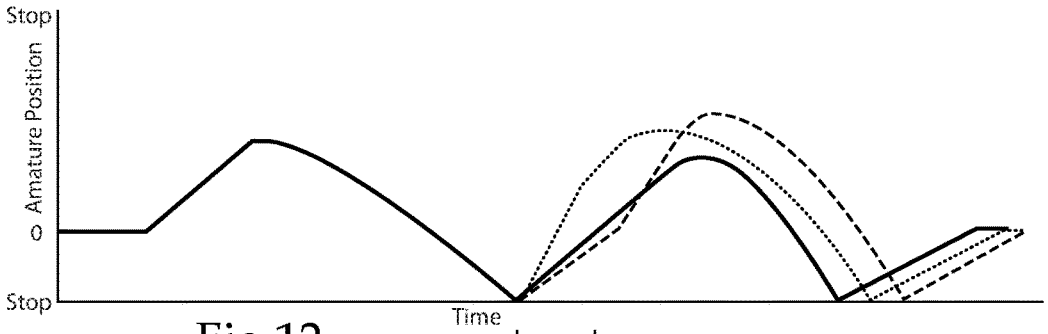
Fig.12
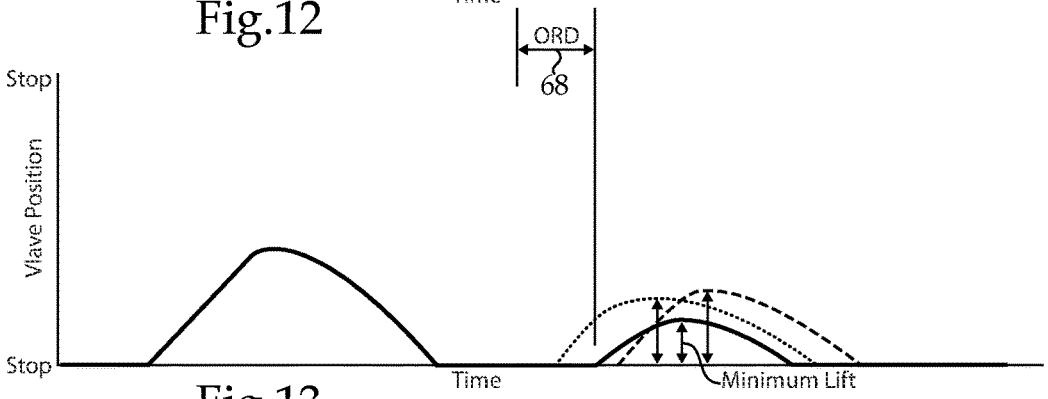
Fig.13
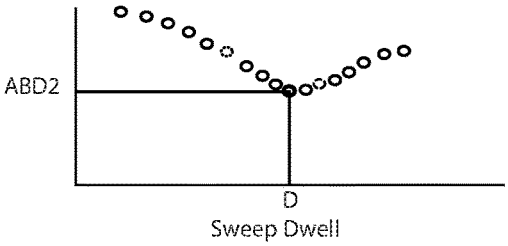
Fig.14
| ORD (68) | EOC Trim (60) |
|---|---|
| .001 | -0.65 |
| .002 | -0.32 |
Fig.15

END-OF-CURRENT TRIM FOR COMMON RAIL FUEL SYSTEM

CROSS-REFERENCE TO RELATED APPLICATIONS

This application is a divisional application, pursuant to 35 U.S.C. §121 and 37 C.F.R. 1.53(b)(1), of U.S. patent application Ser. No. 14/153,485, filed Jan. 13, 2014, which is fully incorporated herein by reference.

TECHNICAL FIELD

The present disclosure relates generally to trimming electronic control signals for fuel injectors, and more particularly to determining an end-of-current trim for certain electronically controlled fuel injectors.

BACKGROUND

Electronically controlled fuel injectors typically utilize a solenoid to open and close a small pressure control valve to facilitate injection events. For many years the control valve structure of these electronically controlled fuel injectors utilized a solenoid with an armature attached to move with a valve member. Each injection event involves energizing a solenoid to move the armature/valve member between two stops against the action of a biasing spring. Depending upon whether the valve is two way or three way, one or both of the stops can be valve seats. Soon after the adoption of these electronically controlled fuel injectors, engineers discovered that each fuel injector responded slightly differently to the same control signal. In addition, the response of an individual fuel injector to the same control signal could vary significantly over the life of the fuel injector. These variances from nominal behavior can be attributed to geometric tolerances, slight differences between otherwise identical components, wear, temperature and other factors known in the art as well as other possibly still yet unknown causes.

Engineers soon began devising ways of estimating or measuring how much the behavior of an individual fuel injector deviated from an expected nominal behavior in response to a known control signal, and then applying trimmed control signals so that the individual fuel injector behaved more like a nominal fuel injector. For instance, if a nominal control signal resulted in the fuel injector injecting slightly too much fuel, the trimmed control signal might have a slightly briefer duration than the nominal control signal resulting in the fuel injector injecting about the same amount of fuel as would be expected in response to the nominal control signal. These slight control signal changes are often referred to in the industry as electronic trims.

U.S. Pat. No. 7,469,679 teaches a strategy for trimming electronic control signals to an electronically controlled valve in which the armature and valve member are attached together and move as a unit. In that specific example, a solenoid is energized to move the armature and valve member from contact with a first seat (stop) to contact with a second seat (stop) to open a pressure control passage to either a high pressure source or a low pressure drain to facilitate an injection event. The armature and valve are returned to their original positions when the solenoid is de-energized under the action of a return spring. When the valve member hits a seat, the motion of the armature abruptly stops, causing a brief induced current event in the electronic circuit associated with the solenoid. By comparing the timing of the induced current event to the expected timing of when the valve member should contact the seat, one can measure how much the behavior of that individual electronically controlled valve deviates from nominal, and construct a trimmed control signal that causes the valve member to contact the seat at the expected timing, resulting in a fuel injection event that more closely resembles a nominal fuel injection event.

More recently, electronically controlled valves for fuel injectors have become more sophisticated to the point where, in some instances, the armature can move with respect to the valve member. For instance, one such valve allows the armature to overtravel and decouple from the valve member after the valve member has contacted its seat. Unfortunately, utilizing the trim determination strategy associated with valves in which the armature and valve member move as a unit will not work because the induced current event, if any, does not occur responsive to the valve member contacting its seat. It is valve closure timing, rather than armature motion, that is most important to ascertaining fuel injection variations. While these more sophisticated valves may allow for performance advantages over their previous counterparts, the causes of valve behavior variations remain. Because the old strategies are no longer applicable, developing electronic trim for control signals to these more sophisticated electronically controlled valves can be problematic.

The present disclosure is directed toward one or more of the problems set forth above.

SUMMARY

In one aspect, a method of operating a fuel injector includes injecting fuel in a first injection event by energizing a solenoid of the injector for a first on-time that terminates at a first end-of-current timing. An end-of-current trim is determined at least in part by estimating a duration between an induced current event in a circuit of the solenoid and a valve/armature interaction event. Fuel is then injected in a second injection event, which is subsequent to the first injection event, by energizing the solenoid for a second on-time, which is different from the first on-time, and terminates at a second end-of-current timing that is the first end-of-current timing adjusted by the end-of-current trim.

In another aspect, a common rail fuel system includes a high pressure pump fluidly connected to a common rail. A plurality of fuel injectors are fluidly connected to the common rail, and each of the fuel injectors includes a valve and a solenoid with an armature. An electronic controller is in control communication with the high pressure pump and each of the plurality of fuel injectors, and includes an end-of-current trim determination algorithm configured to determine an individual end-of-current trim for each of the plurality of fuel injectors. The end-of-current trim determination algorithm is configured to determine each end-of-current trim at least in part by estimating a duration between an induced current event in a circuit of the solenoid and a valve/armature interaction event for each of the plurality of fuel injectors.

BRIEF DESCRIPTION OF THE DRAWINGS

FIG. 11 is a graph of current verses time for diagnostic events according to the present disclosure;

FIG. 12 is a graph of armature position verses time for the diagnostic events of FIG. 11;

FIG. 13 is a graph of valve position verses time for the diagnostic events of FIG. 11;

FIG. 14 is a graph of second armature bounce delay verses dwell time for a plurality of diagnostic events including those of FIG. 11;

FIG. 15 is a look up table of end-of-current trim verses overtravel return delay according to another aspect of the present disclosure.

DETAILED DESCRIPTION

Figure 1:
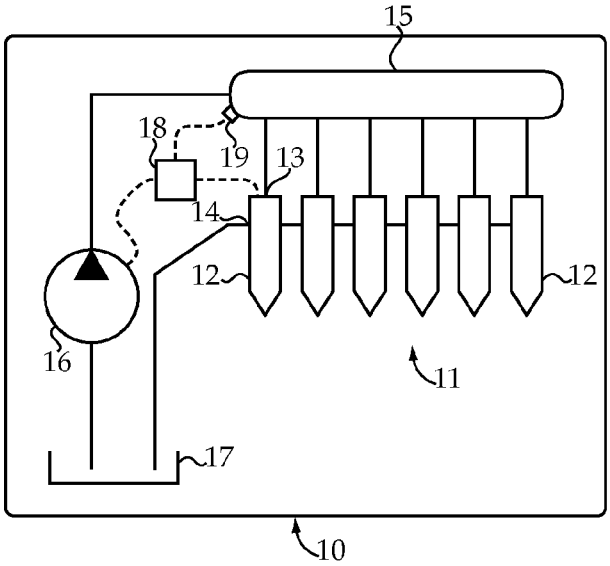
FIG. 1 is a schematic view of an engine with a common rail fuel system according to the present disclosure.
Figure 2:
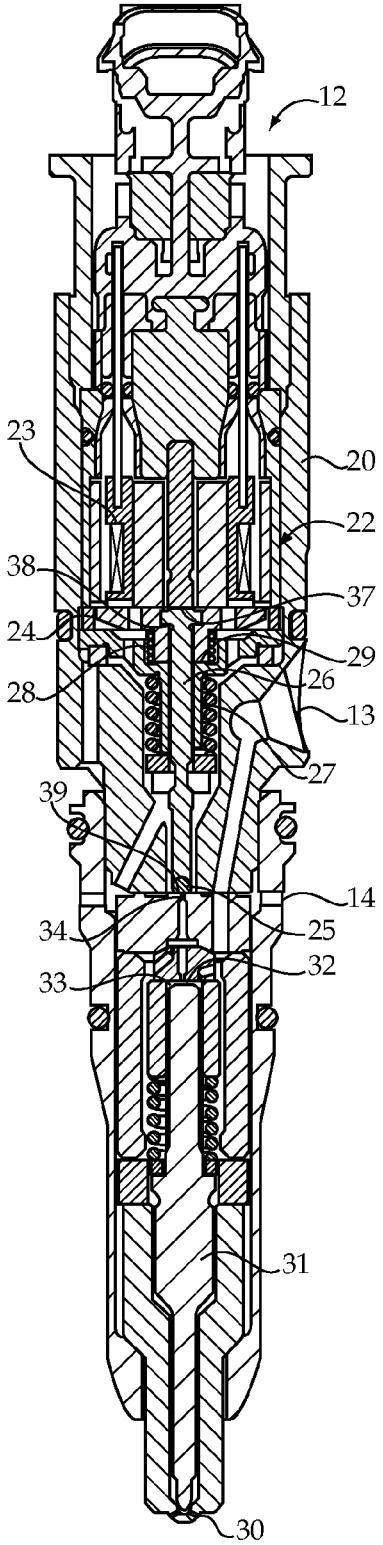
FIG. 2 is a side sectioned view of one of the fuel injectors from the engine of FIG. 1.

Referring initially to FIGS. 1 and 2, an engine 10 is equipped with a common rail fuel system 11 that includes a common rail 15. Engine 10 may be a compression ignition engine, and common rail 15 may contain pressurized distillate diesel fuel. Common rail fuel system 11 includes a high pressure pump 16 fluidly connected to the common rail 15, and a plurality of fuel injectors 12 that are each fluidly connected to common rail 15 at an inlet 13. High pressure pump 16 draws fuel from a tank 17, which is also fluidly connected to drains 14 of the fuel injectors 12. A pressure sensor 19 may communicate pressure information in common rail 15 to an electronic controller 18. Electronic controller 18 is in control communication with the high pressure pump 16 and each of the plurality of fuel injectors 12 (only one control communication link is shown). In particular, electronic controller 18 may be in control communication with an electronically controlled valve 22 of each of the fuel injectors 12. The electronically controlled valve 22 includes a solenoid made up of a coil 23 and an armature 24 operably coupled to a valve member 25 to open and close a flat seat 39.

Each fuel injector 12 includes an injector body 20 that defines an inlet 13, a drain 14 and a nozzle outlet 30. Fuel is injected by moving a needle check 31 from a downward closed position, as shown, to an upward open position to fluidly connect nozzle outlet 30 to inlet 13. Control over this process is accomplished by changing pressure in a needle control chamber 33. Needle check 31 includes a closing hydraulic surface 32 exposed to fluid pressure in needle control chamber 33. Needle control chamber 33 is fluidly connected to a pressure control passage 34 that opens through seat 39. When the valve member 25 is in its downward position in contact with seat 39, pressure control passage 34 is closed, and the prevailing pressure in needle control chamber 33 is the pressure associated with inlet 13 and common rail 15. When the valve member 25 moves out of contact with seat 39, needle control chamber 33 becomes fluidly connected to low pressure drain 14 by way of pressure control passage 34 to allow pressure in needle control chamber 33 to drop, and allow needle check 31 to lift to its open position to commence an injection event.

Figure 3:
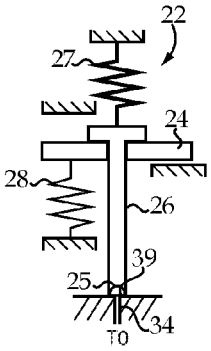
FIG. 3 is a schematic view of the electronically controlled valve for the fuel injector of FIG. 2 at the initiation of a fuel injection event.
Figure 4:
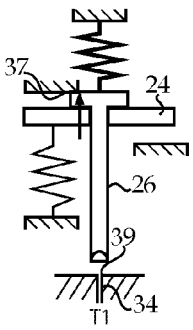
FIG. 4 is a view of the electronically controlled valve of FIG. 3 after the solenoid has been energized and the armature has contacted its upper stop.
Figure 5:
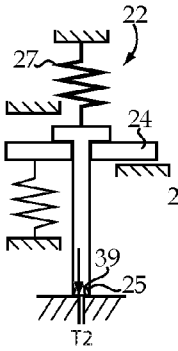
FIG. 5 is a schematic view of the electronically controlled valve of FIGS. 3 and 4 after the solenoid has been de-energized and the valve member has moved back downward into contact with its seat.
Figure 6:
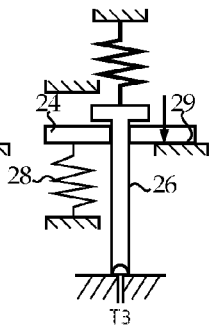
FIG. 6 shows the electronically controlled valve of FIGS. 3-5 when the armature has overtraveled and contacted an overtravel stop.
Figure 7:
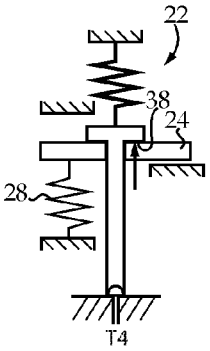
FIG. 7 shows the electronically controlled valve of FIGS. 3-6 after the armature has returned to its original configuration.

Referring in addition to FIGS. 3-7, electronically controlled valve 22 includes an armature 24 that is operatively coupled to valve member 25 by a pin 26. A valve spring 27 is operably positioned to bias pin 26 and valve member 25 downward toward its closed position in contact with seat 39. An overtravel spring 28, which has a lower pre-load than valve spring 27, is operably positioned to bias armature 24 into contact with a contact shoulder 38 of pin 26. FIGS. 2 and 3 show an electronically controlled valve 22 with solenoid coil 23 de-energized, with armature 24 in contact with pin 26, and valve member 25 in contact with seat 39 to close pressure control passage 34. FIG. 4 shows the positioning of the components after coil 23 has been energized. When this occurs, armature 24 is magnetically pulled in the direction of coil 23 until pin 26 contacts upper stop 37. High pressure in pressure control passage 34 pushes valve member 25 upward to open the fluid connection between needle control chamber 33 and drain 14, relieving pressure on closing hydraulic surface 32 of needle check 31. When this occurs, needle check 31 lifts to commence an injection event. Toward the end of an injection event, solenoid coil 23 is de-energized. When this occurs, valve spring 27 pushes pin 26, armature 24 and valve member 25 downward until valve member 25 contacts seat 39 (FIG. 5). Armature 24 continues in its downward movement de-coupling from pin 26, further compressing overtravel spring 28, and eventually contacting with and bouncing off of overtravel stop 29 (FIG. 6). Shortly thereafter, armature 24 moves back upward under the action of spring 28 and remaining momentum after bouncing off of overtravel stop 29 to eventually contact shoulder 38 of pin 26. This returns the electronically controlled valve 22 to its original configuration as shown in FIG. 7.

Thus, unlike older electronically controlled valves known in the art, the electronically controlled valve 22 of the illustrated embodiment includes an overtravel feature that allows the armature 24 to move with respect to the valve member 25 after valve member 25 has contacted seat 39. There are several reasons outside of the scope of this disclosure for why an electronically controlled valve 22 having an overtravel feature can provide performance improvements over the older valves where the armature was directly attached to move with the valve member at all times. However, one reason is that the de-coupling of the armature 24 from the pin 26 when the valve member 25 contacts seat 39, reduces the incidence of bounce off the seat 39 to reduce the likelihood of secondary injections, which has sometimes plagued fuel injectors of the prior art.

Figure 8:
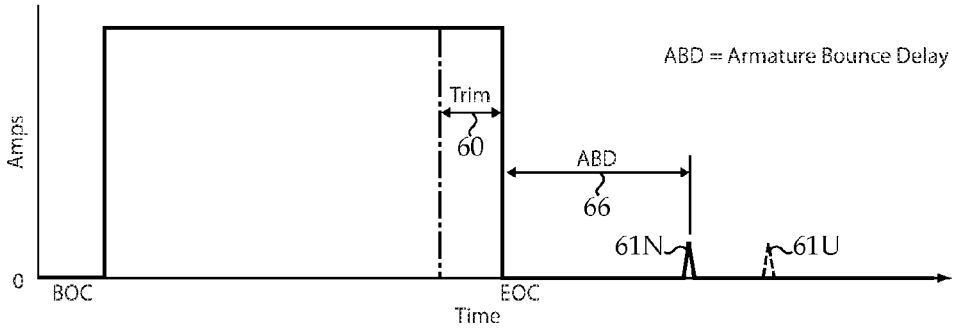
FIG. 8 is a graph of current verses time for example fuel injection events.
Figure 9:
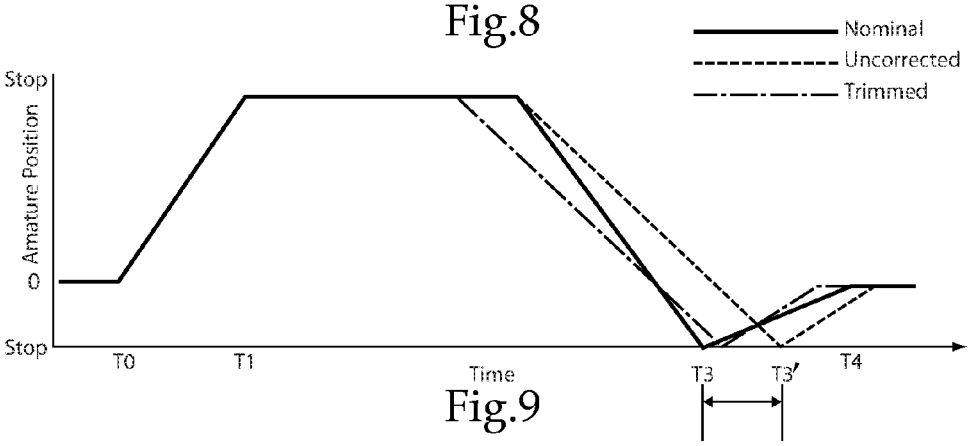
FIG. 9 is a graph of armature position verses time for the fuel injection events of FIG. 8.
Figure 10:
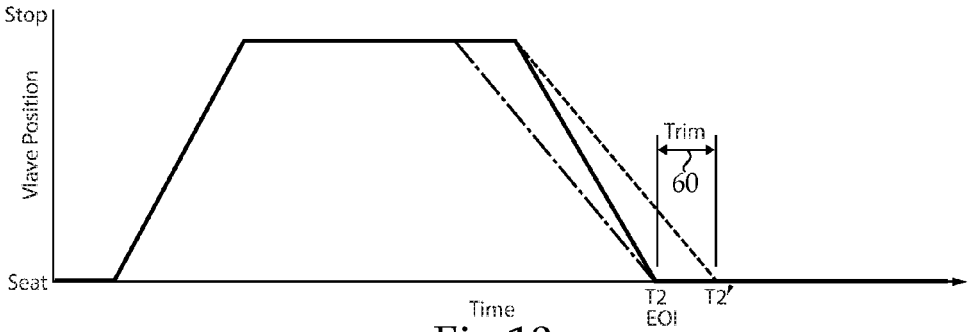
FIG. 10 is a graph of valve position verses time for the fuel injection event of FIG. 8.

Referring now in addition to FIGS. 8-10, the current in the solenoid circuit (FIG. 8) verses time is shown adjacent armature position (FIG. 9) and valve position (FIG. 10) for example injection events according to a nominal trace (solid line, FIGS. 8-10), an uncorrected trace (dashed line, FIGS.

8-10) and a corrected or trimmed trace (dot/dash line, FIGS. 8-10). The injection event begins at T0 at a beginning-of-current (BOC) to coil 23. When this occurs, as expected the armature 24 and valve member 25 move toward their upward open position until stopping at T1, which corresponds to the configuration shown in FIG. 4. Around the time of T1, or shortly thereafter, the needle check 31 lifts to its open position and the spray of fuel out of nozzle outlet 30 commences. At end-of-current (EOC) the solenoid coil 23 is de-energized. The armature 24 and valve member 25 then move downward toward their closed positions. At or around time T2, when seat 39 becomes closed as shown in FIG. 5, the injection event ends. At time T3 (FIG. 6), during armature 24 overtravel, the armature contacts overtravel stop 29. Of interest is the graph of FIG. 8 showing induced current events 61N and 61U associated with contacting the overtravel stop 29 for the curves associated with the nominal and uncorrected injection events, respectively. The time between the end-of-current (EOC), and the induced current event 61 is identified as an armature bounce delay (ABD) 66 in the graph of FIG. 8. Those skilled in the art will appreciate that the electronic controller 18 can sense the timing of the induced current event 61 in the circuit associated with solenoid coil 23, and therefore be able to precisely determine the duration of the armature bounce delay 66. Of interest is noting that the difference between T3 (nominal) and T3' (un-corrected) is different than the time between T2 and T2'. Thus, while the electronic controller 18 can precisely sense the timing of T3, controller 18 cannot directly sense the valve closing event T2, making it difficult to arrive at a end-of-current trim 60 that would cause the valve 22 to close at the desired timing T2. In other words, by adjusting the nominal control signal of FIG. 8 by the end-of-current trim 60, the electronically controlled valve 22 can be made to close at about the same time as T2, resulting in an injection event that more closely resembles a nominal injection event (solid line, FIG. 8-10). Those skilled in the art will appreciate that the end-of-current trim 60 is different from the difference between timing T3 and T3'. The present disclosure is directed to determining a correct end-of-current trim 60 when the valve closing event T2 cannot be directly sensed, but the armature bounce event associated with timing T3 can be sensed. Those skilled in the art will appreciate that the timing of the end of injection (EOI) is associated with the valve closing timing T2, rather than the armature bounce event associated with timing T3.

Because of component differences caused by geometrical tolerances, variations in spring loads, differences in friction forces, and many other factors, the overtravel action of each electronically controlled valve 22 of each fuel injector 12 will be different. Thus, attempting to arrive at an end-of-current trim only by looking at the difference between the nominal armature bounce event at T3 and the uncorrected armature bounce event at T3' can lead to an inaccurate end-of-current trim determination. However, the present disclosure insightfully recognizes that the time between T3 when the armature hits overtravel stop 29, and time T4 when the armature returns to contact with pin 26, is highly correlated with the time difference between valve closing at T2 and armature bounce at time T3. This insight makes sense because, if one can characterize the motion of the armature 24 with respect to the valve member 25 at one portion in the overtravel mode, one can accurately predict what that motion looks like elsewhere during the overtravel mode.

Figure 16:
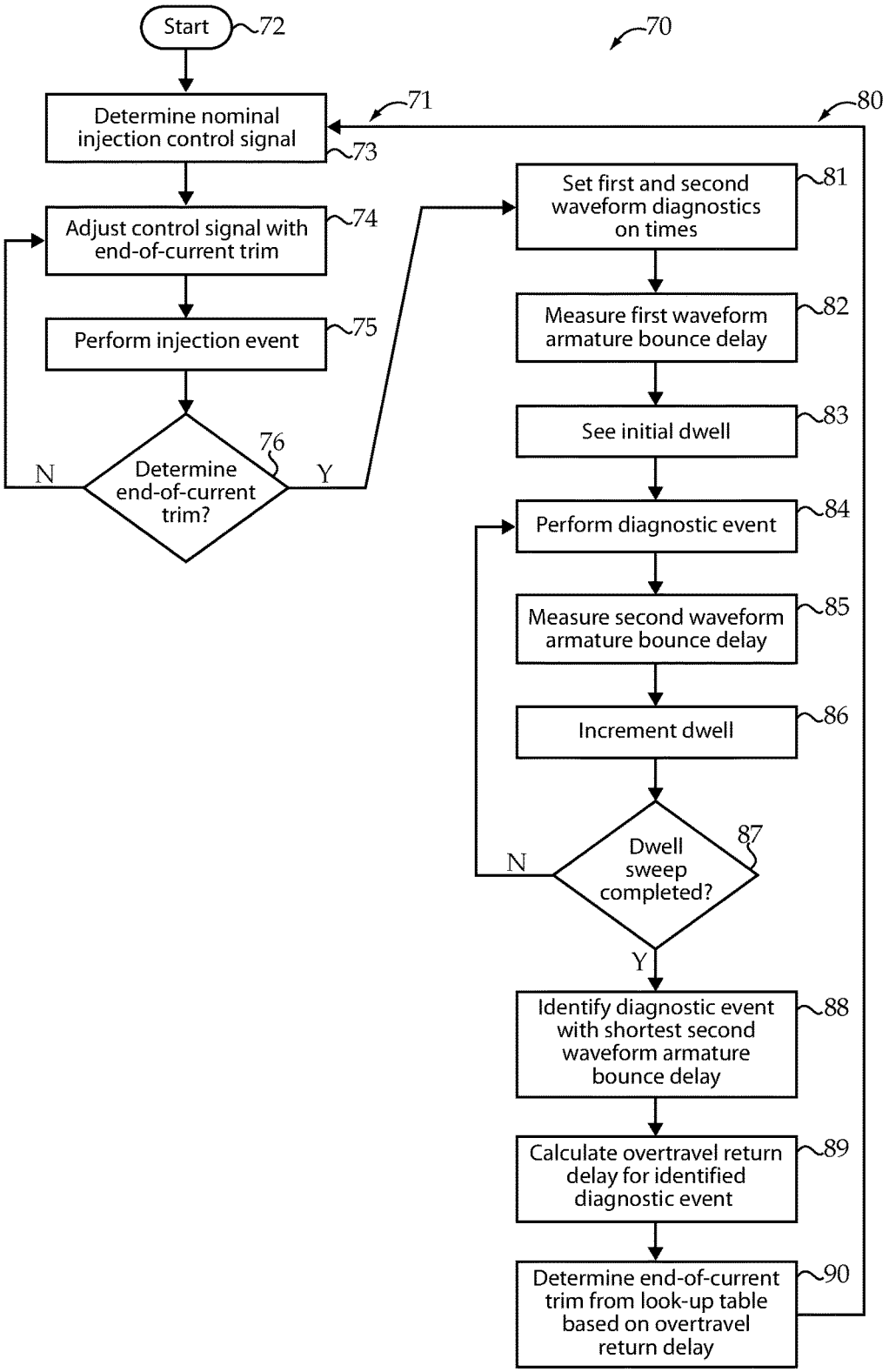
FIG. 16 is a logic flow diagram that includes an end-of-current trim determination algorithm according to the present disclosure.

The logic flow diagram of FIG. 16 along with the graphs of FIGS. 11-15 are included to show one example way of leveraging this insight for an electronically controlled valve 22 in which the armature 24 can move with respect to the valve member 25. This strategy can be used to arrive at an accurate end-of-current trim 60 to adjust a control signal to an individual fuel injector 12 to produce an injection event closely resembling a nominal injection event. Those skilled in the art will appreciate that, not only does the overtravel motion of each individual valve 22 vary from one another, but that motion also varies during the life of each individual fuel injector 12. Thus, determining an accurate end-of-current trim 60 for an individual injector 12 may not remain accurate over the life of the fuel injector. Thus, an individual end-of-current trim 60 may need to be determined a plurality of times over the life of the injector 12. For instance, one end-of-current trim 60 may be determined when the fuel injector 12 is put in service, another updated end-of-current trim 60 may be determined after a break-in period, and then one or more additional times during the life of that individual fuel injector 12 in order to maintain an accurate end-of-current trim 60.

Those skilled in the art will recognize that accurately sensing the timing of an induced current event has been used in the past to directly determine electronic trim for fuel injectors equipped with electronically controlled valves in which the armature does not move with respect to the valve member, such as by being affixed thereto. In those circumstances, the valve returning to its seat coincides with the induced current event induced by the armature coming to an abrupt stop when the solenoid coil is de-energized. However, when the electronically controlled valve 22 has a structure that permits armature movement with regard to the valve member 25, the induced current event 61 occurs at a different timing than valve member 25 contacting seat 39. Nevertheless the present disclosure proposes a strategy that utilizes the same feedback mechanism of the armature contact with overtravel stop 29 (FIG. 6), but utilizes this information in a new way to characterize the overtravel delay from valve return (T2, FIG. 5) to armature bounce (T3, FIG. 6) so that variances from nominal can be compensated for.

Referring now in addition to FIGS. 11-15, the solution involves introducing a first diagnostic on-time 63 in the solenoid coil 23 to produce enough valve lift to provide a full overtravel response from the valve 22. As used in this disclosure, full overtravel response means that the armature 24 has enough momentum to strike the overtravel stop 29 during its overtravel motion. In a preferred version, the diagnostics of the present disclosure are performed between regular injection events such that the first diagnostic on-time 63 provides a full overtravel response from the valve, but not enough to produce any fueling, and may be an insufficient on-time for the armature 24 to reach its upper stop 37 (FIG. 4). The first armature bounce delay 66 is measured from the end of the first diagnostic on-time 63 to the induced current event 61A that occurs when the armature 24 contacts overtravel stop 29. A second diagnostic on-time 64 is then introduced at no dwell offset or a small dwell offset from the timing of the induced current event 61A. An example of such a waveform is shown by dotted lines in FIG. 11. At this timing, one could expect the armature momentum to provide assistance to the valve lift of the second diagnostic on-time 64. Together, the first diagnostic on-time 63 separated by dwell 65 from the second diagnostic on-time 64 can be considered a diagnostic event 62 according to the present disclosure. Next, electronic controller 18 may adjust the duration of the second diagnostic on-time 64 so that sufficient lift is achieved by the forced applied by the second wave form to again achieve full overtravel response. This may be done by monitoring the second armature bounce delay 67, and then increasing the duration of the second diagnostic on-time 64 until it approximates that produced by the first diagnostic on-time 63. It may be helpful that the armature 24 does not reach upper stop 37 during this process in order to reduce signal processing complications. Once the duration of the second diagnostic on-time 64 is set, the dwell 65 between the first and second wave forms is swept.

During the dwell sweep, a plurality of different diagnostic events 62 are performed with the dwell 65 being swept from the value corresponding to the first armature bounce delay 66 (dotted line, FIG. 11) through a timing where a trough in the second armature bounce delay 67 is detected (FIG. 14). The second armature bounce delay 67 corresponds to the time between the end-of-current of the second diagnostic on-time 64 through to the induced current event 61B associated with armature bounce off of overtravel stop 29. In other words, depending upon the dwell 65, the second armature bounce delay 67 will change as shown in FIG. 11. In particular, FIG. 11 shows an induced current event 61B associated with the solid line diagnostic on-time 64, a dotted line induced current event 61B' associated with a diagnostic on-time 64' corresponding to the dotted line, and an induced current event 61B" corresponding to the diagnostic on-time 64" shown in FIG. 11 with a dashed line. The present disclosure insightfully recognizes that, at a certain dwell D (FIGS. 11, 14) the beginning of current for the second diagnostic on-time 64 corresponds to when the armature 24 has contacted contact shoulder 38 of pin 26. At this timing, a minimum amount of valve lift occurs as shown in FIG. 13, because the valve lift associated with the second diagnostic on-time 64 does not get the benefit of armature momentum still existing from the motion caused by the first diagnostic on-time 63. FIG. 14 shows a plot of different second armature bounce delay 67 verses dwell 65 with the local minimum occurring at minimum valve lift at dwell D, which is shown in FIGS. 11-13 by the solid line.

By identifying the dwell D associated with the minimum lift, one can infer that the start of current for the second diagnostic on-time 64 occurred when the armature 24 re-contacted pin 26. This in turn allows for the calculation of the overtravel return delay (ORD) 68, which is the time between the induced current event 61A associated with the armature contacting overtravel stop 29, and the timing at which the armature contacts shoulder 38 of pin 26 (Beginning of current of diagnostic on time 64 at dwell D). Because the motion of the armature 24 before and after the bounce off of overtravel stop 29 are related due to individual mass properties and the like, the overtravel return delay 68 is correlated to an accurate end-of-current trim 60. As used in this disclosure, overtravel return delay 68 means the difference between the first induced current event (61A)(FIG. 11) associated with time T3 (see FIG. 9), and the valve/armature interaction event associated with T4 (see FIG. 9). As used in this disclosure, an induced current event 61 means a current induced in the circuit for the solenoid coil 23 caused by an abrupt change in the motion of armature 24, such as by contacting overtravel stop 29. A valve/armature interaction event according to the present disclosure means the occurrence of when the armature 24 either starts moving with respect to, or stops moving with respect to, the valve member 25. Thus, according to the present disclosure a valve/armature interaction event occurs at time T2 (FIG. 10) when the armature 24 begins moving with respect to valve member 25 for overtravel, and a second valve/armature interaction event occurs at time T4 (FIG. 9) when the armature finishes its overtravel and recouples with pin 26 by contacting contact shoulder 38.

Reiterating, the present disclosure recognizes that the time from the armature 24 hitting the overtravel stop 29 (induced current event 61A, FIG. 11) to the beginning of current of the second diagnostic on-time 64 (corresponding to the trough in the graph of FIG. 14 at dwell D) is the overtravel return delay 68 and, is highly correlated to the time between the valve member 25 hitting at seat 39 (T2) and the time that the armature hits its overtravel stop 29 (T3). Recognizing this correlation, a look up table of overtravel return delay (ORD) verses end-of-current trim 60, such as that shown in FIG. 15, can be prepared and stored on electronic controller 18 before engine 10 is put into service. In other words, this correlation likely does not vary significantly over the life of the fuel injector and therefore can be prepared beforehand.

Those skilled in the art will appreciate that each diagnostic event 62 of each dwell 65 in the sweep of different dwells may be performed a plurality of times in order to average the results for each individual dwell 65 to get more accurate results. When the dwell sweep is performed by gradually increasing dwell 65, the dwell may be incremented in a fine enough increment in order to produce a clear minimum at dwell D in the second armature bounce delay 67 as shown in FIG. 14. After determining the end-of-current trim 60 using the look up table from FIG. 15, the subsequent injection event may be performed as shown in FIGS. 8-10 to cause the fuel injector 12 to close valve 22 at a timing associated with a fuel injector exhibiting nominal behavior, to produce a more accurate injection event, which means closer to nominal.

INDUSTRIAL APPLICABILITY

The present disclosure finds general applicability to electronically controlled valves that permit relative motion between an armature and an associated valve member. The present disclosure finds specific applicability to common rail fuel systems that utilize an electronically controlled valve to control injection events in which the electronically controlled valve includes an overtravel feature. Overtravel permits the armature to overtravel and move with respect to valve member 25 after the valve member 25 contacts seat 39 to end an injection event. Other relative motion armature and valve structures might also apply the insights of this disclosure.

Referring now to FIG. 16, electronic controller 18 includes a fuel injector control algorithm 70 that includes a fueling algorithm 71 and an end-of-current trim determination algorithm 80. The end-of-current trim determination algorithm 80 is configured to determine an individual end-of-current trim 60 for each of the plurality of fuel injectors 12. Each end-of-current trim 60 is determined at least in part by estimating a duration between an induced current event 61 in a circuit of solenoid coil 23 and a valve/armature interaction event for each of the plurality of fuel injectors 12.

At oval 72 algorithm 70 starts. At box 73, electronic controller 18 determines a nominal injection control signal in a manner well known in the art. At box 74, the control signal is adjusted with an end-of-current trim 60, if any, before performing an injection event at block 75. For instance, fuel may be injected in a first injection event by energizing solenoid coil 23 of a fuel injector 12 for a first on-time that terminates a first end-of-current timing, which is identified as EOC in FIG. 8. At query 76, electronic controller 18 queries whether to determine an end-of-current trim 60. For instance, if electronic controller 18 has determined that the fuel injectors 12 have achieved break in, query 76 may return a yes and proceed to execute the end-of-current trim determination algorithm 80.

At box 81, the first diagnostic on-time 63 and the second diagnostic on-time 64 for the diagnostic events 62 are set. At box 82, the first armature bounce delay 66 is measured by detecting the time between end-of-current for the first diagnostic on-time 63 and the induced current event 61A corresponding to armature bounce (FIG. 11). Next, at box 83 the initial dwell is set to correspond to about the timing (61A) of the first armature bounce delay (ABD1). A diagnostic event 62 is then performed at box 84. The second armature bounce delay 67 is measured and stored at box 85 in order to compare the second armature bounce delays 67 for other diagnostic events. At box 86, the dwell 65 is incremented. At query 87, the algorithm 80 determines whether the dwell sweep has been completed. If not, the logic loops back to block 84 to perform another diagnostic event 62 with a different dwell 65. The second armature bounce delay 67 is then measured and recorded at box 85, and the dwell is again incremented at box 86. After this loop is performed enough times to gather enough data to construct a graph of the type shown in FIG. 14, query 87 will return a yes and advance to box 88. Thus, the dwell 65 of each diagnostic event 62 in the sweep is different for each of the plurality of diagnostic events. At box 88, the logic identifies which diagnostic event 62 of the plurality of diagnostic events has a second armature bounce delay 67 that is smaller than the armature bounce delay of the remaining diagnostic events of the plurality of diagnostic events, as identified in the graph of FIG. 14. At box 89, the overtravel return delay 68 for the identified diagnostic event 62 is calculated. Next, at box 90, the end-of-current trim 60 may be determined based upon the calculated overtravel return delay 68, such as by utilizing a look up table of the type suggested by FIG. 15. Next, the logic loops back to continue regular fueling according to the fueling algorithm 71.

The end-of-current trim 60 can be considered as being determined at least in part by estimating a duration (overtravel return delay 68) between an induced current event 61A in the circuit of solenoid coil 23 and a valve/armature interaction event (armature 24 contacting contact shoulder 38 at T4). When box 74 is again executed, for a second injection event which is subsequent to the earlier first injection event, the solenoid coil 23 is again energized for a second on-time (dot/dash in FIG. 8), which is different from the first on-time and terminates at a second end-of-current timing that is the first end-of-current timing (EOC in FIG. 8) adjusted by the end-of-current trim 60.

Preferably, the multiple diagnostic events associated with the end-of-current trim determination algorithm 80 are performed between injection events and done so without causing any fueling. Nevertheless, some fueling could occur during the execution of the end-of-current determination algorithm 80 without departing from the scope of present disclosure. In other words, the diagnostic on-times 63 and 64 are preferably chosen to be sufficiently long to move the valve member 25 out of contact with seat 39, but insufficiently long to inject fuel from fuel injector 12.

Those skilled in the art will appreciate that each injection event for fuel injector 12 includes moving valve member 25 out of contact with seat 39 to open pressure control passage 34 to drain 14, and then moving the valve member 25 back into contact with seat 39 to close pressure control passage 34. Movement of the valve member 25 includes moving armature 24, which is operably coupled to valve member 25. In the illustrated structure, armature 24 overtravels after valve member 25 contact seat 39 to end an injection event. Preferably the end-of-current trim determination algorithm 80 and its associated diagnostic events 62 occur after a first regular injection event but before a second injection event according to the regular fueling algorithm 71. As best shown in FIG. 11, the solenoid coil 23 is energized and de-energized twice during each diagnostic event 62.

Preliminary data suggests that accurate determination of an end-of-current trim 60 according to the present disclosure can correct up to 3% fueling change per injection event as the overtravel motion of the electronically controlled valve 22 changes with wear, break in and age. In addition, the end-of-current trim 60 can help to linearize the delivery curve and potentially reduce minimum delivery control, and potentially correct for other aging effects that may change the valve seating time. The technique of the present disclosure could also potentially be used as a diagnostic to indicate that there is insufficient overtravel in a specific armature 24 for one of the fuel injectors 12, which can suggest an insufficient sealing force of the valve member 25 on seat 39. Those skilled in the art will appreciate that insufficient sealing force can be exhibited by excessive fueling from an extended end of injection (EOI) or possibly even merging two adjacent fueling shots into one.

It should be understood that the above description is intended for illustrative purposes only, and is not intended to limit the scope of the present disclosure in any way. Thus, those skilled in the art will appreciate that other aspects of the disclosure can be obtained from a study of the drawings, the disclosure and the appended claims.

What is claimed is:

1. A common rail fuel system comprising:

a common rail;

a high pressure pump fluidly connected to the common rail;

a plurality of fuel injectors fluidly connected to the common rail, and each of the fuel injectors includes a valve and a solenoid with an armature;

an electronic controller in control communication with the high pressure pump and each of the plurality of fuel injectors, and including an end-of-current trim determination algorithm configured to determine an individual end-of-current trim for each of the plurality of fuel injectors;

wherein the end-of-current trim determination algorithm is configured to determine each end-of-current trim at least in part by estimating a duration between an induced current event in a circuit of the solenoid and a valve/armature interaction event for each of the plurality of fuel injectors.

2. The fuel system of claim 1 wherein the valve of each of the fuel injectors includes a valve member movable between a first position in contact with a seat to block a pressure control passage to a drain, and a second position out of contact with the seat to open the pressure control passage to the drain;

wherein the armature of the solenoid is operatively coupled to the valve member; and the armature is movable with respect to the valve member toward an overtravel stop when the valve member is at the first position.

3. The fuel system of claim 2 wherein the induced current event is associated with the armature contacting an overtravel stop.

4. The fuel system of claim 3 wherein the end-of-current trim determination algorithm is configured to energize the solenoid for a plurality of diagnostic events.

5. The fuel system of claim 4 wherein a diagnostic on-time for each diagnostic event is sufficiently long to move the valve member out of contact with the seat, but insufficiently long to inject fuel from the fuel injector.

6. The fuel system of claim 5 wherein the solenoid is energized and de-energized twice during each of the diagnostic events.

7. The fuel system of claim 6 wherein each diagnostic event includes a first diagnostic on-time separated by a dwell from a second diagnostic on-time.

8. The fuel system of claim 7 wherein the dwell of each diagnostic event of the plurality of diagnostic events is different.

9. The fuel system of claim 8 wherein the end-of-current trim determination algorithm is configured to identify which diagnostic event of the plurality of diagnostic events has an armature bounce delay that is smaller than the armature bounce delay of the remaining diagnostic events of the plurality of diagnostic events.

10. The fuel system of claim 9 wherein the end-of-current trim determination algorithm is configured to calculate an overtravel return delay for the identified diagnostic event; and configured to determine the end-of-current trim based on the overtravel return delay.

* * * * *